US007367999B2

(12) United States Patent
Fujimoto

(10) Patent No.: US 7,367,999 B2
(45) Date of Patent: May 6, 2008

(54) ULTRAFINE PARTICLES AND METHOD AND APPARATUS FOR PRODUCING THE SAME

(75) Inventor: Hiroshi Fujimoto, Kanagawa (JP)

(73) Assignee: Fujifilm Corporation, Minato-Ku, Tokyo (JP)

( * ) Notice: Subject to any disclaimer, the term of this patent is extended or adjusted under 35 U.S.C. 154(b) by 339 days.

(21) Appl. No.: 10/994,614

(22) Filed: Nov. 23, 2004

(65) Prior Publication Data

US 2005/0126340 A1 Jun. 16, 2005

Related U.S. Application Data

(62) Division of application No. 10/205,397, filed on Jul. 26, 2002, now abandoned.

(30) Foreign Application Priority Data

Jul. 27, 2001 (JP) ..... 2001-228521

(51) Int. Cl.
*B22F 9/04* (2006.01)

(52) U.S. Cl. ..... 75/336; 75/345; 75/367; 204/192.32; 977/888; 264/430

(58) Field of Classification Search ..... 75/336, 75/345, 347, 367
See application file for complete search history.

(56) References Cited

U.S. PATENT DOCUMENTS 5,156,693 A 10/1992 Ide et al.
5,403,375 A 4/1995 König et al.
5,876,684 A * 3/1999 Withers et al. ..... 423/445 B
6,121,191 A 9/2000 Komatsu et al.
7,125,525 B2 * 10/2006 Mauro ..... 422/186
2004/0065170 A1 4/2004 Wu et al.

FOREIGN PATENT DOCUMENTS

JP 49-52163 A 5/1974
JP 50-64850 A 6/1975
JP 60-039106 A 2/1985
JP 62-061601 A 3/1987
JP 62-112711 A 5/1987
JP 03-034211 A 2/1991
JP 6-260724 A 9/1994
JP 2000-178613 A * 6/2000

OTHER PUBLICATIONS

S. Yatsuya et al., "Preparation of Extremely Fine Particles by Vacuum Evaporation Onto a Running Oil Substrate," *Journal of Crystal Growth*, 45 (1978), pp. 490-494.

* cited by examiner

*Primary Examiner*—George Wyszomierski
(74) *Attorney, Agent, or Firm*—Buchanan Ingersoll & Rooney PC

(57) ABSTRACT

A method of producing ultrafine particles by vaporization comprising: vaporizing a target by sputtering; causing particles that fly from the target by vaporization to be deposited on an oil surface; and recovering the oil on which the flown particles have deposited to obtain individually dispersed ultrafine particles.

6 Claims, 2 Drawing Sheets

ULTRAFINE PARTICLES AND METHOD AND APPARATUS FOR PRODUCING THE SAME

CROSS-REFERENCE TO RELATED APPLICATION

This application is a divisional of application Ser. No. 10/205,397, filed Jul. 26, 2002 now abandoned, the contents of which are incorporated herein by reference.

BACKGROUND OF THE INVENTION

1. Field of the Invention

The present invention relates to ultrafine particles, and to a method and an apparatus for producing the same. As used herein, the term "ultrafine particle" refers to fine particles having an average particle size ranging from 1 nm to 50 nm, that is, so-called "nano size particles" (occasionally referred to as "nano particles").

2. Description of the Related Art

Conventionally, various methods of producing ultrafine particles have been researched. Since nano particles having an average particle size of below dozens of nano meters cannot be obtained by grinding, build-up methods have been used. Primary examples of build-up methods can be divided into gas phase methods, such as condensation by evaporation and vapor phase reaction, and liquid phase methods, such as precipitation and desolvation.

As an example of a liquid phase method, Japanese Patent Application Laid-Open (JP-A) No. 2000-54012 discloses a method of forming, through reduction, magnetic nano crystals made of metals, intermetallic compounds and alloys. Although it is possible to obtain ultrafine particles having a relatively uniform particle size, the method has limitations in that raw materials must be dissolved as a solution and only a compound having a stoichiometric composition ratio is obtained.

When the gas phase method is used, a thin film can relatively easily be formed. However, various procedures are needed to recover a product in the form of nano particles. For example, JP-A No. 2001-35255 introduces silver or oxygen using in-gas evaporation to obtain nano particles of silver oxide. The *Journal of Crystal Growth* 45 (1978), pp. 490 to 494, proposes a method of producing ultrafine particles of higher purity by vacuum evaporation on a rheological oil surface (VEROS method). In this method, resistance overheating or an electron beam is used as the evaporation source. However, although these methods are suitable for forming particles made of a single-element of noble metals, it is difficult to produce ultrafine particles made of two or more metal elements. It is also the case that there is no effective way of producing nano particles of alloys having an arbitrary composition.

In the VEROS method described above, resistance overheating, an electron beam or the like is used for vaporization. In this method, when a multi-element base target is used, a problem arises in that, timing of evaporation may shift depending on a difference in a vapor pressure, whereby only giving single-element particles and failing to produce composite particles. In order to solve this problem, it is conceivable to use ion beams as vaporizing means to vaporize a multi-element base target having the form of molecules or an alloy. However, in this case, vaporization efficiency is poor and the apparatus cost is high. Further, these methods require a relatively high vacuum. In order to individually disperse fine particles, it is necessary to either discharge the vaporized molecules from the system before aggregation occurs or protect the surface, and for this purpose, a medium that adheres to the surfaces of particles must be present in the vacuum system. Consequently, there are problems in that the degree of vacuum is decreased and the vaporizing means cannot function in an ordinary manner.

As stated above, it is difficult to obtain nano size particles having a variety of compositions and applicable to various objects by liquid phase methods, and such nano size particles cannot be obtained by gas phase methods such as a CVD method. Because particles aggregate to form a film within one to several seconds even if ordinary sputtering is used, there is currently no specific method capable of producing nano size particles.

Moreover, when arranging nano particles in the form of a film, it is effective to coat a colloidal solution of nano particles. However, it is necessary to select a dispersing medium and a coating equipment suited for particle constituent elements. Although gas phase methods are known in which fine particles are recovered by causing vaporized particles to adhered to a dispersion medium, there is the problem that the particles easily coagulate when their concentration is high. There has also been a demand for a method of readily producing a stable colloidal solution of nano particles.

SUMMARY OF THE INVENTION

An object of the present invention is to solve the aforementioned problems associated with the prior art and to attain the following object. That is, an object of the invention is to provide a method and an apparatus for readily producing individually dispersed ultrafine particles having an arbitrary composition and an arbitrary composition ratio and a colloidal solution thereof at a low cost, and to provide ultrafine particles that are obtained by the method and the apparatus.

The aforementioned problems are solved by the following means.

A first aspect of the invention is a method of producing ultrafine particles by vaporization comprising: vaporizing a target by sputtering; causing particles that fly from the target by vaporization to be deposited on an oil surface; and recovering the oil on which the flown particles have deposited to obtain individually dispersed ultrafine particles.

A second aspect of the invention is a method of producing ultrafine particles by vaporization comprising: vaporizing a target by sputtering; cooling and solidifying particles that fly from the target by vaporization; and recovering the flown particles that have been solidified by cooling to obtain individually dispersed ultrafine particles.

A third aspect of the invention is an apparatus for producing ultrafine particles by vaporization comprising: means for vaporizing a target by sputtering; an oil on which particles that fly from the target by vaporization are deposited; and means for recovering the oil on which the flown particles have deposited.

A fourth aspect of the invention is an apparatus for producing ultrafine particles by vaporization comprising: means for vaporizing a target by sputtering; means for cooling and solidifying particles that fly from the target by vaporization; and means for recovering the flown particles that have been solidified by cooling.

DESCRIPTION OF THE PREFERRED EMBODIMENTS

Figure 1:
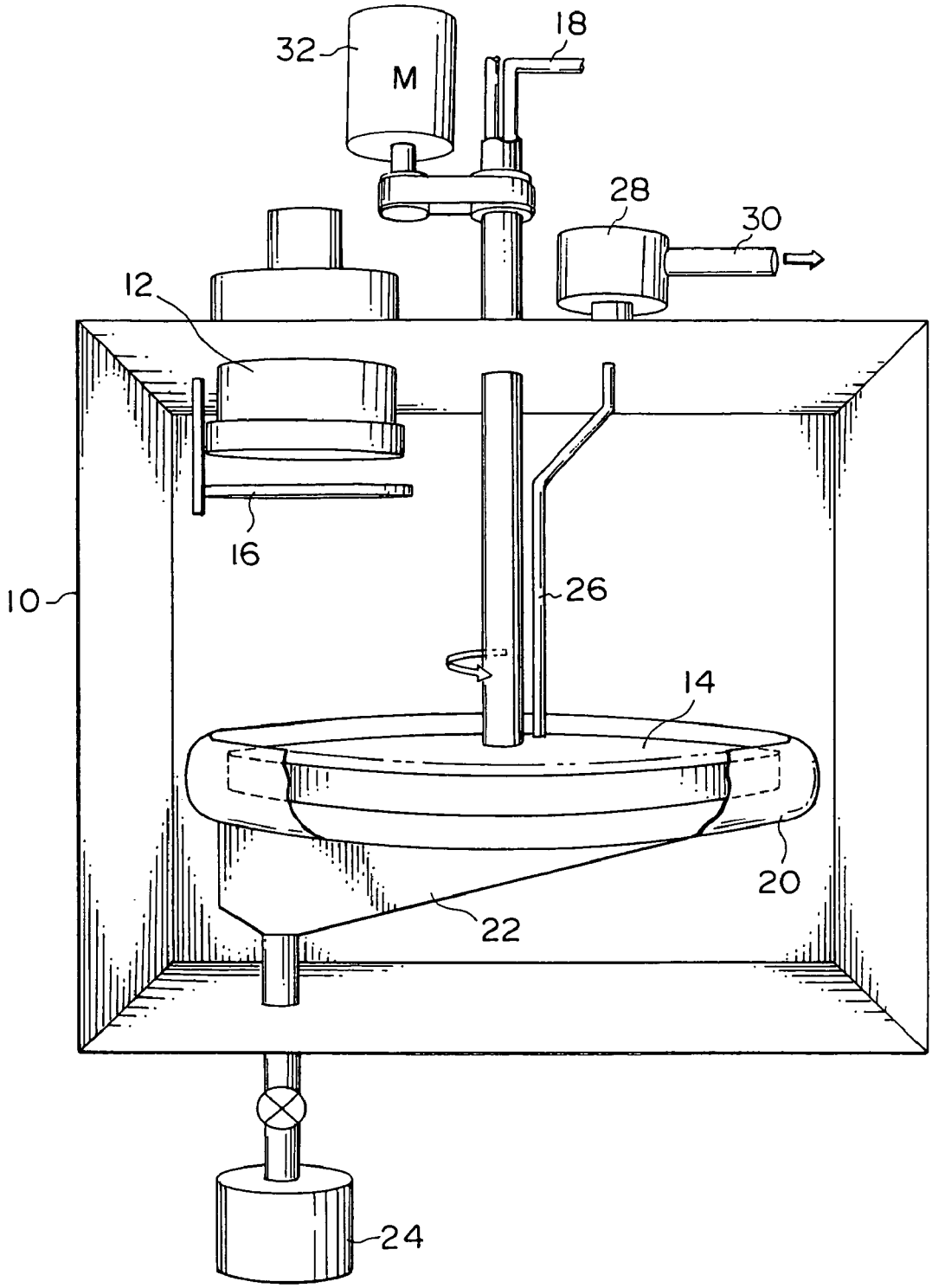
FIG. 1 is a schematic structural view showing a first embodiment of an apparatus for producing ultrafine particles of the present invention.

First and second embodiments of the present invention are described in detail below. An apparatus for producing ultrafine particles of the invention, the ultrafine particles of the invention, and a method of producing the ultrafine particles of the invention are also described.

First Embodiment

The method according to the first embodiment of the invention is a method of producing ultrafine particles by vaporization comprising: vaporizing a target by sputtering; causing particles that fly from the target by vaporization to be deposited on an oil surface; and recovering the oil on which the flown particles have deposited to obtain individually dispersed ultrafine particles.

In the method of producing ultrafine particles according to the first embodiment of the invention, multi-element based ultrafine particles can be produced by employing sputtering for vaporization (vaporizing means). Further, particles can be flown normally in the presence of a medium such as an oil even under vacuum. By causing particles to be deposited on an oil surface, individually dispersed ultrafine particles can readily be obtained without causing aggregation of the particles. Therefore, by the method of producing ultrafine particles according to the first embodiment, individually dispersed ultrafine particles having an arbitrary composition and an arbitrary composition ratio or a colloidal solution thereof can stably be obtained, in a simple manner and at a low cost.

In the method of producing ultrafine particles according to the first embodiment of the invention, suitable examples of the oil to form an oil surface include silicone-based oils having a boiling point of 200° C. or more, α-terpineol, hydrocarbons having 6 or more carbon atoms and alcohols having a high boiling point. Various additives may be included in these oils. Preferable examples of the additive include alkylphosphine oxides, alkylphosphines and the compounds containing at least one selected from —SH, —CN, —$NH_2$, —$SO_2OH$, —SOOH, —$OPO(OH)_2$ and —COOH. Among them, alkylphosphine oxides and the compounds containing at least one selected from —SH and —COOH are preferable. It is appropriate that the oil has been deaerated.

In the method of producing ultrafine particles according to the first embodiment of the invention, it is preferable that the oil surface is formed on a substrate (a flat plate) such that a suitable oil thin film can readily be formed. The substrates are preferably made of metals or resins which have been smooth-treated. The substrates are selected from the materials that are adaptable to the oil used. It is particularly preferable if an oil thin film is formed uniformly on a substrate and can be fluidized at an arbitrary speed as described later. Therefore, for the purpose of controlling the surface tension of the substrate, it is preferable to perform surface treatment of the substrate as necessary.

In the method of producing ultrafine particles according to the first embodiment of the invention, it is preferable that the oil surface is a fluidized oil surface obtained by fluidizing an oil, from the standpoints of recovering an oil efficiently and obtaining individually well-dispersed ultrafine particles. By causing particles to be deposited on the fluidized oil surface, particle growth can be suppressed, whereby ultrafine particles having a minute and uniform particle size can readily be obtained. As the method of fluidizing an oil, i.e., the method of forming a fluidized surface, the method to form the fluidized surface on a rotating substrate surface, the method to form the fluidized surface on an inclined substrate, and the like are suitably used. These methods may be used in combination. As used herein, the term "inclined" of the inclined substrate means that a vertical line on the substrate surface is inclined with respect to the gravity direction.

In case of forming a fluidized surface on the surface of a rotating substrate, when a substrate processed to have the shape of a disk is rotated, an oil can uniformly be fluidized to achieve a preferable fluidized oil surface in a simple manner. The rotational speed of the rotating substrate preferably ranges from about 10 rpm to about 500 rpm. An oil is preferably supplied from a position substantially around the center of the rotating shaft of the rotating substrate, and the supply is continuously maintained without interruption. The oil feeding speed is preferably from 0.01 ml/min to 2 ml/min per unit area of the rotating substrate. The fluidized oil surface may be formed either at the upper surface (the surface provided opposite to the gravity direction: in this case sputtering is conducted in the direction of downward) or at the lower surface (the surface provided in the gravity direction: in this case sputtering is conducted in the direction of upward) of the rotating substrate. It is more preferable to form a fluidized surface on the upper surface of the rotating substrate. If a fluidized oil surface is formed at the lower surface of the rotating substrate, there may arise a problem that an oil drops on a vaporizing means to cause pollution or other troubles depending on a low rotational speed and physical properties of an oil (e.g., low viscosity). Besides, if conducted downwardly, sputtering can release flown particles more efficiently. From the standpoints, it is preferable to form a fluidized oil surface on the upper surface of the rotating substrate.

In case of forming a fluidized oil surface on an inclined substrate surface, it is suitable that oil supply is carried out such that an oil can spread over an entire surface of the inclined substrate. For example, it is preferable to supply an oil such that the oil can flow from the upper end to the lower end of the inclined substrate.

Suitably, a substrate is cooled in both of the rotating substrate method and the inclined substrate method described above. A substrate may be cooled in the same manner as conducted by a cooling method (means) described in the second embodiment below. Water may be used as a cooling medium.

In the method of producing ultrafine particles according to the first embodiment of the invention, when the above-described rotating substrate method is employed, an oil on which flown particles (ultrafine particles) have deposited can be recovered, for example, in such a manner that particles that collided (deposited) to the fluidized oil surface of the rotating substrate surface are flown to the periphery by a centrifugal force caused by rotation of the rotating substrate, and the oil flown outside of the periphery and including the particles is captured by a member which protects the substrate periphery and then the oil is collected to one site. In the inclined substrate method, an oil that has dropped on the lower end of the inclined substrate may be stored in a tank and the like. In both of the above-described rotating substrate method and inclined substrate method, an oil may be supplied in a circulating mode. That is, the oil recovered at an oil recovering portion can be delivered, for circulation, to an oil feeding portion such that the oil can be continuously used until ultrafine particles (flown particles) reach a predetermined concentration.

The recovered oil may be concentrated by vacuum or vacuum heating, as necessary. Further, after recovered, the oil may preferably be replaced with other organic solvents (e.g., organic solvents having a lower boiling point than that of the oil, such as, toluene, xylene, hexane, alcohols having 6 or less carbon atoms) depending on use purposes. The concentration rate may vary and range from about 10 to 40% by weight, depending on the composition of ultrafine particles and the solvent used.

The first embodiment of an apparatus suitably used for the method of producing ultrafine particles according to the invention is illustrated below, referring to a drawing.

The apparatus for producing ultrafine particles shown in FIG. 1 comprises a sputtering device 12 for vaporization (vaporizing means) and a rotating substrate 14 capable of rotating to form a fluidized oil surface in a vacuum chamber 10. The sputtering device 12 has, for example, a target (not shown) having a necessary composition previously prepared by calcination, and additionally, a shutter 16 in the vacuum chamber 10. The rotating substrate 14 has a vacant structure to which a cooling medium is introduced from a cooling medium inlet 18, to cool the rotating substrate 14 from inside. Regions around the periphery of the rotating substrate 14 are covered with a protecting member 20. To serve as the particle recovering means, the protecting member 20 is connected with an oil recovering tube 22 in the shape of a float, and the oil recovering tube 22 is further connected with an oil recovering tank 24 outside of the vacuum chamber 10. In the vicinity of the rotating shaft of the rotating substrate 14, an oil feeding tube 26 is arranged to enable an oil supplied to the upper surface near the rotating shaft of the rotating substrate 14. The oil feeding tube 26 is connected with an oil feeding tank 28 outside of the vacuum chamber 10. And to the oil feeding tank 28, an evacuating tube 30 is connected. Rotation of the rotating substrate 14 is controlled by a motor 32.

In an apparatus for producing ultrafine particles shown in FIG. 1, a cooling medium is introduced from the cooling medium inlet 18 to cool the rotating substrate 14. Rotation of the rotating substrate 14 is controlled by the motor 32, and an oil is continuously supplied, through the oil feeding tube 26, to a position around the rotating shaft of the rotating substrate 14 from the oil feeding tank 28, to thereby form a fluidized oil surface. In this operation, an oil has previously been deaerated through an evacuating tube 30. The shutter 16 provided for the sputtering device 12 is opened to expose a target (not shown) to the vacuum chamber 10 to initiate sputtering. In the initial period, the oxides present on the surface of the target are eliminated and then sputtering is commenced. The flown particles reach the fluidized oil surface formed on the upper surface of the rotating substrate 14, fly away to the periphery by a centrifugal force together with a fluidized oil, are captured by the protecting member 20, and then are collected to the oil recovering tank 24 through the oil recovering tube 22. Thus, ultrafine particles can be obtained. The recovered oil containing the flown particles (ultrafine particles) may be concentrated and replaced, as necessary, to give a desired colloidal product.

Second Embodiment

The method according to the second embodiment of the invention is a method of producing ultrafine particles by vaporization comprising: vaporizing a target by sputtering; cooling and solidifying particles that fly from the target by vaporization; and recovering the flown particles that have been solidified by cooling to obtain individually dispersed ultrafine particles.

In the method of producing ultrafine particles according to the second embodiment of the invention, multi-element based ultrafine particles can be produced by employing sputtering for vaporization (vaporizing means). Further, particles can be flown normally in the presence of a medium such as a vaporized medium even under vacuum. By cooling and solidifying the flown particles, individually dispersed ultrafine particles can readily be recovered without causing aggregation of the particles. Therefore, by the method of producing ultrafine particles according to the second embodiment, individually dispersed ultrafine particles having an arbitrary composition and an arbitrary composition ratio or a colloidal solution thereof can stably be obtained, in a simple manner and at a low cost.

In the method of producing ultrafine particles according to the second embodiment of the invention, in order to perform cooling and solidifying (cooling and solidifying means), for example, a substrate is cooled (a cooled substrate is provided) and the particles flown by sputtering are frozen on the surface of the cooled substrate. In order to cool the substrate, a cooling medium such as liquid nitrogen, liquid carbon dioxide and super-cooled water may be used. By cooling the substrate in such a manner, the flown particles (ultrafine particles) are cooled and solidified (frozen) to cause deposition thereof on the surface of the substrate. Preferably, cooling of the substrate is conducted, for example, by inside cooling in which a cooling medium is circulated into the substrate in order to efficiently deposit the flown particles on the surface of the substrate. The substrate may be rotated at a relatively low speed.

In the method of producing ultrafine particles according to the second embodiment of the invention, it is preferable to use and mediate a vaporized medium. That is, when the substrate is cooled for solidifying the particles, a vaporized medium is adsorbed to the surface of the flown particles (cooling and solidifying means) for modifying the surface, and then the flown particles are cooled and solidified. For use as the vaporized medium, solvents having a relatively low boiling point are preferable. For example, organic solvents having a boiling point of 200° C. or lower are preferable, and more preferable are the organic solvents having a boiling point of 150° C. or lower. Alcohols are particularly preferable. Cooling of the flown particles is accelerated by contacting the particles with a vaporized solvent. Since the vaporized solvent is adsorbed to the surface of the particles for modification thereof, the flown particles are frozen and deposited on the surface of the substrate together with the vaporized solvent. The flown particles (ultrafine particles) are prevented from aggregating with additional particles that will be flown later, by an effect of the vaporized solvent adsorbed to the particle surface, to thus produce ultrafine particles having a small particle size and a narrower particle size distribution. It is also preferable to use, together with the vaporized medium, an adsorbent having a different adsorbing force to the surface of flown particles such that the adsorbent can contact with the flown particles. Suitable examples of the adsorbent include alkylphosphine oxides, alkylphosphines and the compounds containing at least one selected from —SH, —CN, —$NH_2$, —$SO_2OH$, —SOOH, —$OPO(OH)_2$ and —COOH. Among them, alkylphosphine oxides and the compounds containing at least one selected from —SH and —COOH are preferable. More specifically, as a lipophilic adsorbent, adsorbing compounds containing a substituent having a total of 6 or more carbon atoms, preferably 8 to 40 carbon atoms, such as an octyl group, a decyl group, a dodecyl group and a hexadecyl group can be used. As a hydrophilic adsorbing agent, adsorbing compounds having a substituent or a hydrophilic group having 6 or less carbon atoms (e.g., —$SO_3M$, —COOM in which M represents a hydrogen atom, an alkali metal atom, an ammonium molecule and the like) can suitably be used. The fact that the surface of the flown particles (ultrafine particles) is adsorbed by a vaporized medium or an adsorbent can be confirmed by high resolution TME, such as FE-TEM to find that a specified distance is left between the particles, or by chemical analysis.

In the method of producing ultrafine particles according to the second embodiment of the invention, the flown particles (ultrafine particles) solidified by cooling (frozen) can be recovered, for example, by the following procedure. When a substrate is cooled by liquid nitrogen and the like, the flown particles are frozen and deposited on the substrate surface, after which sputtering and the liquid nitrogen supply are halted, vacuum is leaked, the substrate is rotated with gradually raising the temperature to cause the deposited particles (ultrafine particles) adhered by the vaporized solvent to be molten and flown away to the periphery by a centrifugal force, then to be captured by a protecting member arranged around the periphery of the substrate, and finally to be collected to one site.

The second embodiment of an apparatus suitably used for the method for producing ultrafine particles according to the invention is illustrated below, referring to FIG. 2. Members having the same functions as those in an apparatus shown in FIG. 1 are designated by the same symbols.

Figure 2:
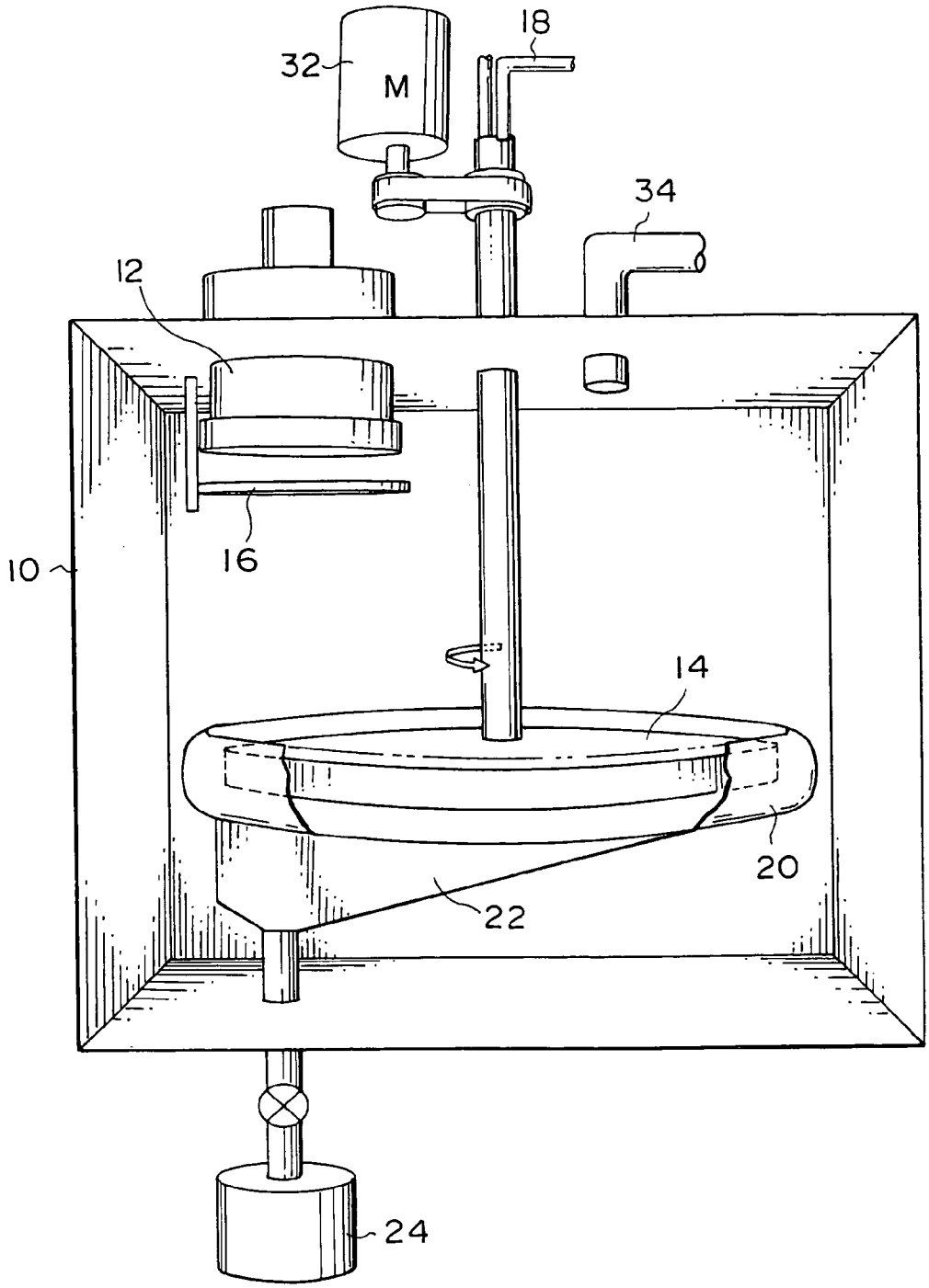
FIG. 2 is a schematic structural view showing a second embodiment of an apparatus for producing ultrafine particles of the invention.

The apparatus for producing ultrafine particles shown in FIG. 2 comprises a sputtering device 12 for vaporization (vaporizing means) and a rotating substrate (a cooled substrate) 14 capable of rotating and of cooling and solidifying the flown particles in a vacuum chamber 10, and additionally, a vaporized medium inlet 34 to introduce a vaporized medium into the vacuum chamber 10. The sputtering device 12 has, for example, a target (not shown) having a necessary composition previously prepared by calcination, and additionally, a shutter 16 in the vacuum chamber 10. The rotating substrate 14 has a vacant structure to which a cooling medium is introduced from a cooling medium inlet 18, to cool the rotating substrate 14 from inside. Regions around the periphery of the rotating substrate 14 are covered with a protecting member 20. To serve as the particle recovering means, the protecting member 20 is connected with a recovering tube 22 in the shape of a float, and the recovering tube 22 is further connected with a recovering tank 24 outside of the vacuum chamber 10. Rotation of the rotating substrate 14 is controlled by a motor 32.

In an apparatus for producing ultrafine particles shown in FIG. 2, a cooling medium is introduced from the cooling medium inlet 18 to cool the rotating substrate 14. A vaporized medium is introduced into the vacuum chamber 10 from a vaporized medium inlet 34. The rotating substrate 14 is rotated by a motor at a low speed of, for example, about 10 to 30 rpm. The shutter 16 provided for the sputtering device 12 is opened to expose a target (not shown) to the vacuum chamber 10 to initiate sputtering. In the initial period, the oxides present on the surface of the target are eliminated and then sputtering is commenced. The particles flown by sputtering are brought into contact with a vaporized medium to cause surface modification or surface adsorption by the vaporized medium, and then are frozen and deposited on the upper surface of the cooled rotating substrate 14. Thereafter, introduction of the cooling medium from the cooling medium inlet 18 is halted. At the time when the frozen and deposited substance starts melting, the rotational speed of the rotating substrate 14 is increased. The frozen deposit is molten and then flown away to the periphery by a centrifugal force caused by rotation of the rotating substrate 14, and is captured by a protecting member 20, and thereafter is collected to a collecting tank 24 via a collecting tube 22. Thus, ultrafine particles can be obtained. Further, the flown particles (ultrafine particles)—containing molten deposit recovered can be concentrated and then replaced, as necessary, to give a desired colloidal product.

The procedures which are common to the first and second embodiments of the invention are described below.

In the method of producing ultrafine particles of the invention, sputtering can be conducted by conventionally known methods. Sputtering may be conducted without any restriction, in the direction of upwardly, downwardly and in the left and right directions. In the invention, "downward" means the gravity direction, and "upward" means the opposite direction.

In the method of producing ultrafine particles of the invention, the target may be any of single-element compounds and multi-element compounds of two or more elements. According to the present invention, it is possible to produce preferable ultrafine particles made of multi-element compounds consisting of two or more elements. Specifically, various composite materials can be used, not to mention of ordinarily used metals, intermetallic compounds or sulfides, and silicon and the oxides thereof. Further, when silver, gold, copper, zinc, iron, cobalt, chromium, nickel, aluminum, as well as chalcogen compounds such as indium, antimony, tellurium and the composite compounds thereof are used, an advantageous effect of the present invention can be exhibited. As the multi-element compound, the oxides and sulfides containing at least one of the metals in the 4th to the 6th periods in the periodic table or the oxides and sulfides of a multi-metal consisting of two or more metals are preferable, and multi-element compounds containing the elements of the groups III, IV, V and VI in the 4th to the 6th periods in the periodic table (at least one element selected from the groups of 13, 14, 15 and 16 according to IUPAC, 1989, inorganic chemical nomenclature, revised version) are more preferable. More specifically, the oxides and sulfides of magnesium, aluminum, silicon, titanium, vanadium, manganese, copper, zinc, gallium, strontium, yttrium, zirconium, silver, indium, cesium, barium and the like, or the oxides and sulfides of the composite material thereof, or multi-element compounds containing silver, germanium, indium, antimony, tellurium and the like in an arbitrary composition ratio are preferable. In the invention, ultrafine particles made of metal multi-element compounds having a stoichiometrically non-applicable composition ratio can readily be produced.

It is preferable in the invention that the distance between a target and an oil surface (or a substrate surface for deposition) can arbitrarily be varied. By varying the distance, particle sizes and surface modification levels may be controlled, whereby applicability of the ultrafine particles can be enlarged.

In the method of the invention, it is possible to produce ultrafine particles having an arbitrary composition and an arbitrary composition ratio, so long as sputtering can be implemented for a given composition. Therefore, ultrafine particles obtained by the method of the invention (ultrafine particles of the invention) can be applied and used in various fields. For example, in optical recording materials, metal chalcogen compounds are used as the recording material. If the metal chalcogen compounds are used in the form of ultrafine particles produced by the present invention, recording sensitivity and recording density can be improved. A functional film can also be obtained by using the ultrafine particles of the invention. A metal chalcogen compound used for optically recording has a composition of Ag, In, Sb and Te, or Ge, Sb and Te, each included in non-stoichiometric ratio. Therefore, it is difficult to formulate the components into a single particle by synthesis. However, ultrafine particles can be produced by the method of the present invention if the calcinated metal chalcogen compound is used as a target for sputtering.

The ultrafine particles obtained by the invention may be included in a layer used for a dielectric material layer which is a constituent element of the optical recording material (particularly, DVD disk). Besides, the ultrafine particles of the invention may be used in a functional layer, in addition to a recording layer and a dielectric material layer.

Furthermore, the obtained ultrafine particles of the invention may be used in the form of a colloidal solution in an organic solvent. Alternatively, a hydrophilic solvent may be replaced to produce a hydrophilic colloidal solution. These colloidal solutions can be spin-coated or web-coated, to give a thinner film.

EXAMPLES

The present invention is described further in detail below with reference to the following examples, but it is to be understood that the invention is not limited to the examples.

Example 1

Ultrafine particles (nano particles) were produced as follows by using an apparatus shown in FIG. 1. In order to produce a target for sputtering, metals of Ag, In, Sb and Te were calcinated at a weight ratio of 1:1:18:7 and the produced target was placed in the sputtering apparatus 12 using a 4-inch backing plate. As the rotating substrate 14, a vacant substrate in the form of disc having a diameter of about 30 cm was produced and rotated at a rotational speed of 450 rpm using the motor 32 while water-cooling was provided by introducing cooling water from the cooling medium inlet 18. α-Terpineol was deaerated for use as an oil, and then supplied through the oil feeding tube 26 to the upper surface of the rotating substrate 14 at a feeding speed of 30 ml/min. In the sputtering device 12, an RF high-rate electric source and a 4-inch planar magnetron-type cathode were used. Inside the vacuum chamber 10, a diffusion pump and a rotary pump were arranged to control the degree of vacuum for sputtering.

Ten minutes after the particle production started, an interval of 3 minutes was provided, and this procedure was repeated three times, to thus perform sputtering for a total of 30 minutes. The particles dispersed in about 700 ml of the recovered oil were observed by a transmission-type electron microscope TEM, to find that nano particles had an average particle size ranging from 3 to 8 nm.

The composition of one particle was investigated by using EF-TEM, to reveal the presence of four elements Ag, In, Sb and Te.

Example 2

Ultrafine particles (nano particles) were produced as follows by using an apparatus shown in FIG. 2. In order to produce a target for sputtering, metals of Ag, In, Sb and Te were calcinated at a weight ratio of 1:1:18:7 and the produced target was placed in the sputtering apparatus 12 using a 4-inch backing plate. As the rotating substrate 14, a vacant substrate in the form of disc having a diameter of about 30 cm was produced and rotated at a rotational speed of 450 rpm using the motor 32 while water-cooling was provided by introducing cooling water from the cooling medium inlet 18. 1-ethoxy-2-propanol containing about 0.1% of sodium mercaptosuccinate and having been vaporized to a degree capable of sputtering was introduced from the vaporized medium inlet 34 into the vacuum chamber. In the sputtering device 12, an RF high-rate electric source and a 4-inch planar magnetron-type cathode were used. Inside the vacuum chamber 10, a diffusion pump and a rotary pump were arranged to control the degree of vacuum for sputtering.

Five-minutes after the particle production started, an interval of 1 minute was provided, and this procedure was repeated five times, to thus perform sputtering for a total of 25 minutes. Thereafter, Ar was introduced into the vacuum chamber 10 to raise the pressure to a normal pressure, and the liquid nitrogen supply was halted. When the frozen deposit on the rotating substrate 14 started melting, a rotational speed of the rotating substrate 14 was increased to 250 rpm, and the molten deposit was recovered.

The particles present in a dispersion (molten deposit) were observed by a transmission-type electron microscope TEM, to confirm that nano particles having an average particle size ranging from 3 to 8 nm could be produced, as obtained in Example 1. This dispersion did not cause precipitation and excellent colloidal conditions were maintained even after 7 hours at an ordinary temperature.

The composition of one particle was investigated by using EF-TEM, to reveal the presence of four elements Ag, In, Sb and Te.

Example 3

Ultrafine particles (nano particles) were produced in a similar manner as in Example 2 except that in place of sodium mercaptosuccinate, polyvinylpyrrolidone having a molecular weight of 1600, sodium citrate and a hydrolyzate of tetraethoxy orthosilicate (TEOS) were used, respectively. The obtained multi-element base nano particles maintained excellent dispersibility.

Example 4

Ultrafine particles (nano particles) were produced in a similar manner to Example 1 except that a calcinated metal made of Ge, Sb and Te at a weight ratio of 2:3:5 was used as a target for sputtering. The resultant ultrafine particles were observed by EF-TEM, to find that the three elements were included in a particle at approximately the same proportion as above. The average particle size ranged from 3 to 9 nm.

As described above, the present invention can provide a method and an apparatus for stably producing individually dispersed ultrafine particles having an arbitrary composition and an arbitrary composition ratio or a colloidal solution thereof in a simple manner and at a low cost, and also provide the ultrafine particles obtained by the method and the apparatus.

What is claimed is:

1. A method of producing ultrafine particles by vaporization comprising:

vaporizing a target by sputtering;

causing particles that fly from the target by vaporization to be deposited on an oil surface; and recovering the oil on which the flown particles have been deposited to obtain individually dispersed ultrafine particles, wherein the target is a multi-element compound.

2. The method according to claim 1, wherein the oil surface is a fluidized oil surface prepared by fluidizing an oil.

3. The method according to claim 2, wherein the fluidized oil surface is formed on the surface of a rotating substrate.

4. The method according to claim 2, wherein the fluidized oil surface is formed on the surface of an inclined substrate.

5. The method according to claim 1, wherein the multi-element compound contains at least one of the metals in the $4^{th}$ to $6^{th}$ periods of the periodic table.

6. The method according to claim 1, wherein the multi-element compound contains at least one element selected from the elements of the groups III, IV, V and VI in the $4^{th}$ to $6^{th}$ periods in the periodic table.

* * * * *